United States Patent [19]

Wiedemann

[11] Patent Number: 4,530,892

[45] Date of Patent: Jul. 23, 1985

[54] ELECTROPHOTOGRAPHIC RECORDING MATERIAL FOR PRINTING FORMS

[75] Inventor: Wolfgang Wiedemann, Geisenheim-Johannisberg, Fed. Rep. of Germany

[73] Assignee: Hoechst Aktiengesellschaft, Frankfurt am Main, Fed. Rep. of Germany

[21] Appl. No.: 477,383

[22] Filed: Mar. 21, 1983

[30] Foreign Application Priority Data

Mar. 23, 1982 [DE] Fed. Rep. of Germany ..... 3210576

[51] Int. Cl.[3] ..... G03G 5/06

[52] U.S. Cl. ..... 430/78; 430/75; 430/76; 430/77; 430/96; 430/319; 430/49

[58] Field of Search ..... 430/75, 76, 77, 78, 430/96

[56] References Cited

U.S. PATENT DOCUMENTS

| | | | |
|---|---|---|---|
| 3,112,197 | 11/1963 | Neugebauer et al. | 96/1 |
| 3,189,447 | 6/1965 | Neugebauer et al. | 96/1 |
| 3,257,203 | 6/1966 | Sues et al. | 96/1.5 |
| 3,287,120 | 11/1966 | Hoegl | 96/1.5 |
| 3,367,937 | 2/1968 | Fuchs et al. | 260/281 |
| 3,842,038 | 10/1974 | Loehr et al. | 260/67 A |
| 3,871,882 | 3/1975 | Wiedemann | 430/76 X |
| 3,904,407 | 9/1975 | Regensburger et al. | 430/96 X |
| 4,028,102 | 6/1977 | Rochlitz et al. | 96/1.5 |
| 4,063,948 | 12/1977 | Lind | 96/1.6 |
| 4,252,880 | 2/1981 | Lind | 430/82 |

FOREIGN PATENT DOCUMENTS

| | | |
|---|---|---|
| 2328727 | 1/1975 | Fed. Rep. of Germany . |
| 2755851 | 6/1979 | Fed. Rep. of Germany . |
| 2726116 | 3/1980 | Fed. Rep. of Germany . |
| 944126 | 12/1963 | United Kingdom . |
| 1416603 | 12/1975 | United Kingdom . |

*Primary Examiner*—Roland E. Martin

*Attorney, Agent, or Firm*—Schwartz, Jeffery, Schwaab, Mack, Blumenthal & Evans

[57] ABSTRACT

The present invention relates to an electrophotographic recording material composed of an electrically conducting coating support which is suitable, in particular, for the manufacture of printing forms or printed circuits, and a photoconductive insulating coating which contains a dye, in dispersion, which is a compound according to the general formula (I)

in which

X is an oxygen atom, or a sulfur atom, or a CO group, and

A is a —CO—B—CO— group, in which

B is an oxygen atom or a —$NR_1$— group, in which $R_1$ is a hydrogen atom, or an alkyl, alkenyl or alkoxyalkyl group with, in each case, at least 1 to 4 carbon atoms, or is an unsubstituted or substituted pheynl or benzyl radical, $R_2$, $R_3$ and $R_4$ are identical or different, and are a hydrogen atom or a halogen atom, or an alkyl or alkoxy group with, in each case, at least 1 to 4 carbon atoms, or an amino or nitro group, n is 1 to 4, p is 1 or 2, and $R_5$ is a hydrogen atom or, together with $R_4$ represents the atoms required for the formation of a fused benzene ring, or a compound according to the general formula

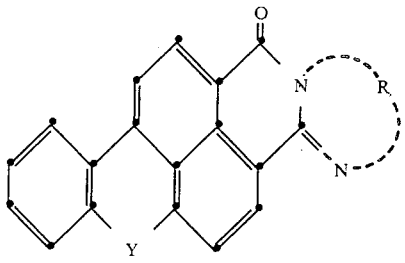
(II) in which
Y is an oxygen atom, or a sulfur atom, and
R is a phenyl or naphthyl radical which is unsubstituted or substituted by nitro, or by alkyl, alkoxy or alkylcarboxy groups with at least 1 to 4 carbon atoms, or by halogen.
10 Claims, 3 Drawing Figures

ELECTROPHOTOGRAPHIC RECORDING MATERIAL FOR PRINTING FORMS

BACKGROUND OF THE INVENTION

The present invention relates to an electrophotographic recording material composed of an electrically-conducting coating support which is suitable, in particular, for the manufacture of printing forms or printed circuits, and a photoconductive insulating coating.

In order to manufacture printing forms, it is known to use photoconductive, monomeric organic compounds, or photoconductive resins composed of condensation products of formaldehyde with various carbocyclic compounds (U.S. Pat. No. 3,842,038) wherein the photosensitivity of these materials generally is in the region between 350 and 430 nm.

In order to bring about the bathochromic shifting of the spectral sensitivity ranges of electrophotographic copying materials, down to approximately 800 nm, it is known to employ sensitizing dyes which are homogeneously dissolved in the photoconductive insulating coating, such as polymethine dyes, triphenylmethane dyes, phthalein dyes, etc. (U.S. Pat. No. 3,189,447; British Pat. No. 944,126; U.S. Pat. No. 4,063,948; U.S. Pat. No. 4,252,880).

The extension of the spectral photosensitivity can also be brought about through the addition of chemical activators, for example, electron-acceptors, according to U.S. Pat. No. 3,287,120, as has been described in German Pat. No. 2,726,116 for a condensation product of formaldehyde with 3-bromopyrene.

The electrophotographic recording material possesses a coating support which is composed of metal, or which has been metallized, and which is suitable for printing purposes. As a rule, the photoconductive insulating coating is composed of a mixture of the photoconductor, a homogeneously dissolved sensitizing dye, and/or an acceptor-compound, and a binder possessing a high molecular weight and containing groups which confer solubility in alkaline media. The plate is electrostatically charged, exposed, and developed with an electrophotographic developer, of the dry type, or of the liquid type. The toner-image obtained is fixed, for example, by heating to 100° C. to approximately 250° C., after which the insulating layer is treated with an aqueous, or alcoholic, alkaline solution, whereby the non-image areas are dissolved away, and a lithographic printing form is produced.

The known recording materials have the disadvantage that their photosensitivity does not yet meet the highest requirements. For this reason, improved photosensitivity of the copying materials is becoming increasingly important in the commercial production of printing forms by automatic techniques. Moreover, it is disadvantageous that these photoconductive coatings possess enhanced conductive properties in the dark, caused by the homogeneously dissolved sensitizing additives, which are frequently present as salts. A certain sensitivity to pre-exposure is also a disadvantage, which necessitates that these materials be stored and handled in the dark.

It is less easy to prepare lithographic printing forms according to German Pat. No. 2,726,116 and German Offenlegungsschrift No. 2,755,851, due to the processes for manufacturing their components from a photoconductive resin of constant quality and acceptor compounds.

Electrophotographic recording materials with photoconductive double layers are also known (British Pat. No. 1,416,603 and U.S. Pat. No. 4,028,102), in which the dyes are present exclusively as constituents of a coating which serves to produce charge carriers. It has, however, been found that the double process step of vapor-depositing the dye coating and the application of a charge-transporting coating is disadvantageous for the manufacture of printing forms and printed circuits, particularly with respect to the later operation of dissolving away the non-image areas, because only incomplete detachment of the dye coating occurs.

SUMMARY OF THE INVENTION

It is therefore an object of the present invention to provide an improved electrophotographic recording material.

Another object of the invention is to provide an electrophotographic recording material, in particular for the manufacture of printing forms or printed circuits by the electrophotographic route.

It is a particular object of the invention to provide such a recording material which is extremely photosensitive over a wide spectral range and possesses good electrophotographic properties which are not affected by handling under conditions involving the action of light.

In accomplishing the foregoing objects, there has been provided in accordance with the present invention an electrophotographic recording material comprising an electrically conducting support member; and a photoconductive insulating coating, comprising a dye, in dispersion, which comprises a compound having the formula:

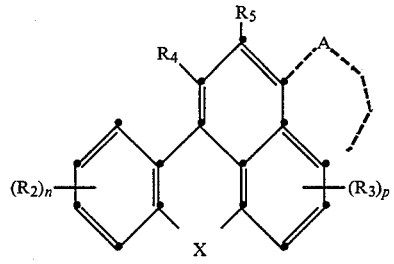

(I)

in which

X is an oxygen atom, or a sulfur atom, or a CO group, and

A is a —CO—B—CO group, in which

B is an oxygen atom or a —$NR_1$— group, in which $R_1$ is a hydrogen atom, or an alkyl, alkenyl or alkoxyalkyl group having, in each case, at least 1 to 4 carbon atoms, or is an unsubstituted or substituted phenyl or benzyl radical, $R_2$, $R_3$ and $R_4$ are identical or different, and are a hydrogen atom or a halogen atom, or an alkyl or alkoxy group having, in each case, at least 1 to 4 carbon atoms, or an amino or nitro group, n is 1 to 4, p is 1 or 2, and $R_5$ is a hydrogen atom, or together with $R_4$ represents the atoms required for the formation of a fused benzene ring, or a compound having the formula (II)

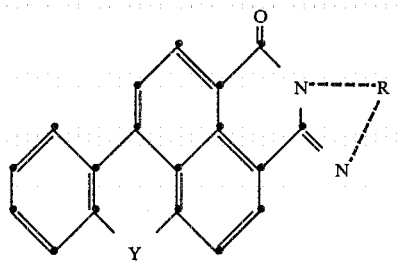

in which

Y is an oxygen atom, or a sulfur atom, and

R is a phenyl or naphthyl radical which is unsubstituted or substituted by nitro, or by alkyl, alkoxy or alkylcarboxy groups having at least 1 to 4 carbon atoms, or by halogen.

Further objects, features and advantages of the present invention will become apparent from the detailed description of preferred embodiments which follows, when considered together with the attached figures of drawing.

DETAILED DESCRIPTION OF PREFERRED EMBODIMENTS

A suitable substituent for $R_1$ in the compounds according to the invention, of general formula I given above, is phenyl and, for $R_2$, suitable substitutents are the alkoxy group, especially the methoxy group, and the nitro group. A suitable substituent for R in the compounds according to formula II is a naphthyl or phenyl which is substituted by the nitro group.

The dye according to the invention can be present in either the cis-form or the trans-form, with reference to the position of X or, as the case may be, of Y, and of the —CO— group. It is presumed, according to the invention, that isomer mixtures are present.

The following table of formulae contains particularly suitable dye compounds, namely:

| | |
|---|---|
| 1. | 10-methoxy-benzoxanthene-3,4-dicarboxylic acid anhydride |
| 2. | Dinitro-1,6-benzothioxanthene-3,4-dicarboxylic acid anhydride |
| 3. | Benzothioxanthene-3,4-dicarboxylic acid N—(3'-nitrophenyl)-imide |
| 4. | Benzothioxanthene-3,4-dicarboxyimido-(N,N'—mono-nitrophenyl-1,2-ene)-3-imidine |
| 5. | Benzothioxanthene-3,4-dicarboxyimido-(N,N'—naphthyl-1,8-ene)-3-imidine |

-continued

1

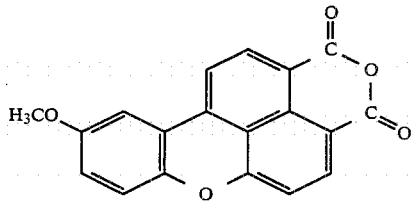

2

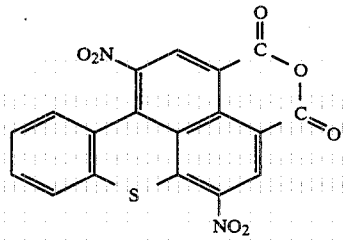

3

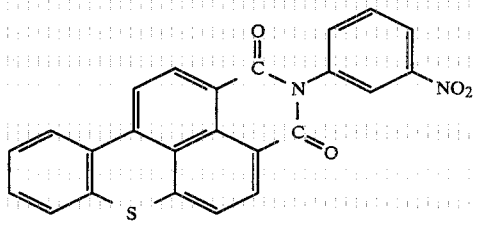

4

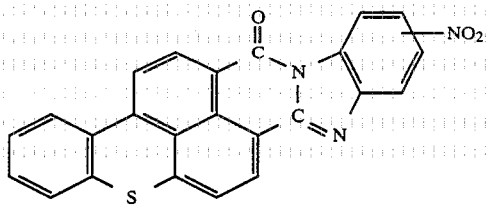

5

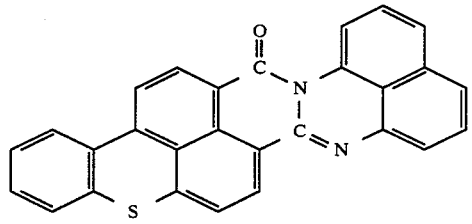

Compounds 1 to 3 have been disclosed in German Offenlegungsschrift No. 1,297,259, the disclosure of which is hereby incorporated by reference. Thus, for example, the Compound 2 (melting point 352° C.) is prepared in accordance with Example 8 of German Offenlegungsschrift No. 1,297,259.

Compounds 4 and 5 are condensation products of o-phenylenediamine or 1,8-diaminonaphthaline with the benzo(thio)xanthene-3,4-dicarboxylic acid anhydride, in which R stands for an unsubstituted or substituted phenyl or naphthyl, or a higher fused aromatic radical, as well as for heterocyclic radicals, for example, a pyridinyl radical. Of these derivatives, those substituted by halogen and alkyl are, according to the invention, particularly suitable. Nitro-substituted compounds are quite particularly suitable. A process for their preparation has been disclosed in German Offenlegungsschrift No. 2,328,727, the disclosure of which is hereby incorporated by reference.

The invention enables a recording material, in particular for the manufacture of printing forms or printed circuits, to be made available, which is highly photosensitive over a wide spectral range and proves to be insensitive to pre-exposure. In addition, a simpler preparation procedure is rendered possible by configuring the photoconductive insulating coating as a monodisperse layer.

Figure 1:
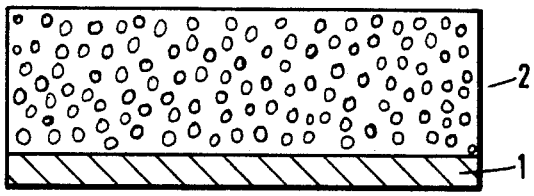
FIG. 1 is a schematic cross-sectional view of one embodiment of the electrophotographic recording material according to the invention.
Figure 3:
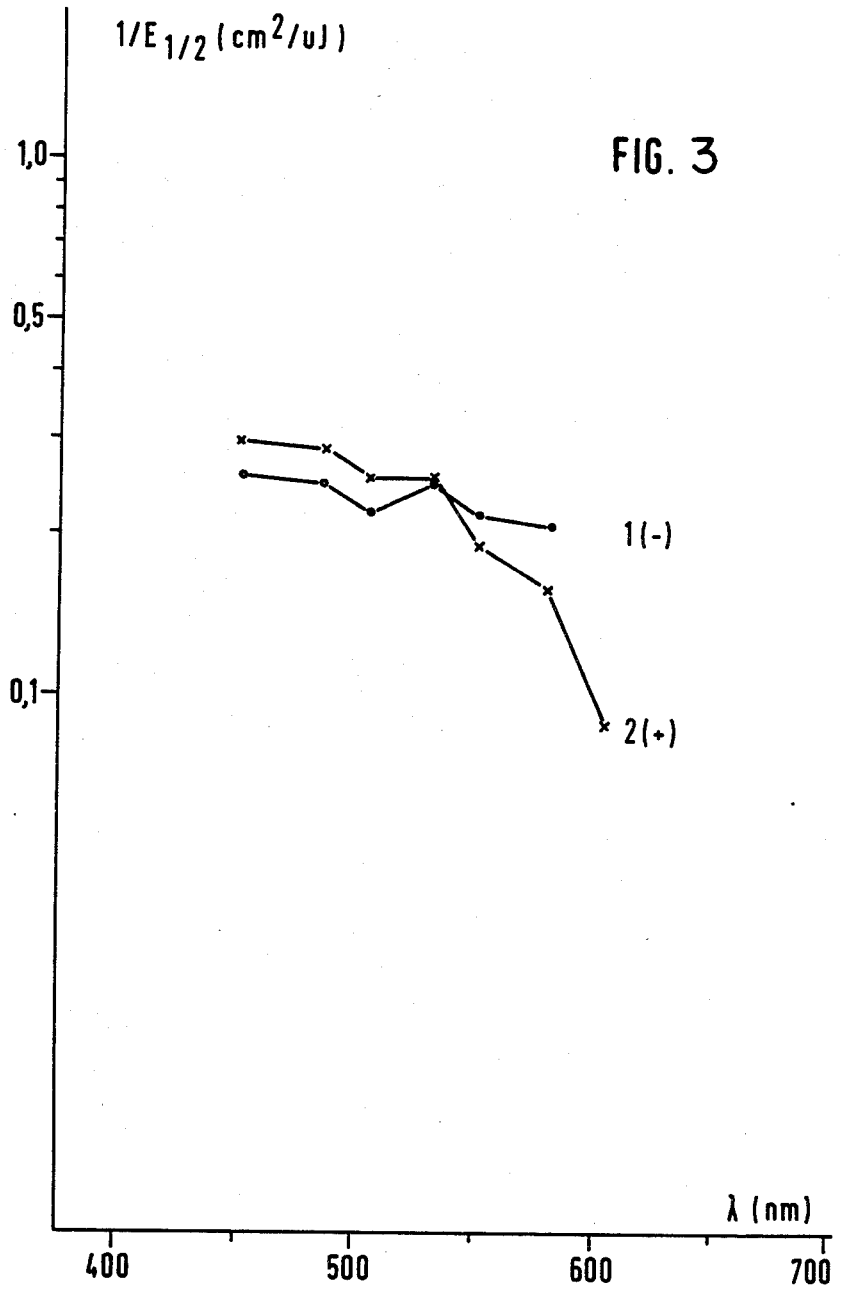
FIG. 3 is a plot of the reciprocal of the half value energy versus the wave length to obtain the spectral photosensitivity.

In order to prepare the electrophotographic recording material, a suitable coating support is provided with a photoconductive insulating coating which contains the dyes, in dispersion, in a manner corresponding to the arrangement (layer 2) in FIG. 1. The dye particles serve as centers for the production of charge-carriers in the charge-transport coating medium, composed, for example, of a photoconductor and a binder. In the visible region, the photosensitivity of the photoconductive insulating coating depends substantially on the absorption by the dye which is present, FIG. 3 showing the spectral photosensitivity of a material according to the invention, containing Compound No. 4 in the table of formulae. The high photosensitivity over a wide spectral range can be inferred from this Figure, both in the case of positive charging and negative charging.

In a practical embodiment, the dye, with particles present in the size range from 1 to 3 μm, is intensively ground with a binder and with a photoconductor, in a ball mill for 1 to 2 hours, with the binder and photoconductor preferably being present in solution. The particle-size of the dye particles is then within the range from about 0.01 to 1 μm. It has been found that a size range between about 0.05 to 0.8 μm is quite particularly advantageous. After coating and drying, homogeneous, deeply-colored photoconductive insulating coatings are obtained, which contain from about 0.1 to 20% by weight of dye, preferably from about 1 to 10% by weight, based on the solids content.

The photoconductive insulating coating essentially contains an organic photoconductor, a dye, and a binder, and, according to the case in question, additional conventional additives, such as activators, plasticizers, levelling agents and the like.

Figure 2:
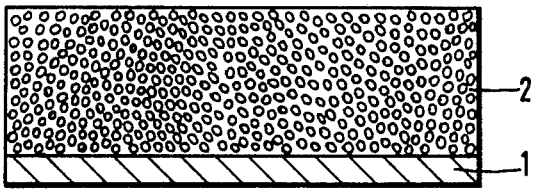
FIG. 2 is a schematic cross-sectional view of a second embodiment of the electrophotographic recording material according to the invention.

A further embodiment relating to the preparation of the photoconductive insulating coating involves a procedure wherein the dye is dispersed in a binder, so that, after grinding, coating and drying, photoconductive dye dispersion coatings are produced, which take the form shown in layer 2 of FIG. 2. In this configuration, the proportion of dye in the dispersion coating can be very high, and can amount to as much as about 50% by weight, based on solid material. In some circumstances, the high solids content is limited only by the poorer adhesion of this insulating layer to the coating carrier.

Monomeric or, alternatively, polymeric aromatic compounds, which may be carbocyclic or heterocyclic, can be considered as possible organic photoconductors for the photoconductive insulating coating. In particular, heterocyclic compounds are employed as monomeric photoconductors, such as oxadiazole derivatives (U.S. Pat. No. 3,189,447). These derivatives include, in particular, 2,5-bis-(4'-diethylaminophenyl)-1,3,4-oxadiazole. Examples of suitable monomeric photoconductive compounds are, furthermore, triphenylamine derivatives, higher fused aromatic compounds, such as anthracene, benzo-fused heterocyclic compounds, pyrazoline derivatives or imidazole derivatives. Triazole derivatives and oxazole derivatives are also suitable monomeric photoconductive compounds, as disclosed in U.S. Pat. Nos. 3,112,197 and 3,257,203, the disclosures of which are incorporated herein by reference. These compounds include, for example, 2-phenyl-4-(2'-chlorophenyl)-5-(4''-diethylaminophenyl)-oxazole.

Suitable polymeric photoconductors are, for example, vinyl-aromatic polymers, such as polyvinyl anthracene, polyacenaphthylene, or copolymers. Poly-N-vinylcarbazole or copolymers of N-vinylcarbazole containing at least approximately 40% of N-vinylcarbazole have proved particularly successful. Products of the condensation of formaldehyde with various aromatic compounds are also suitable, such as, for example, condensation products of formaldehyde with 3-bromopyrene (U.S. Pat. No. 3,842,038).

Having regard to their film-forming properties and their adhesive strength, natural resins or synthetic resins are suitable resin binders, in particular polyester resins, polycarbonates, polyurethanes, polyvinyl acetals, various grades of cellulose nitrate, etc. In addition to their film-forming properties, electrical properties, and strength of adhesion to the coating support substrate when being employed for printing forms or printed circuits, their solubility properties, above all, play a special part in their selection. Those resin binders which are soluble in aqueous or alcoholic solvent systems, if appropriate with concurrent additions of acid or alkali, are particularly suitable for practical purposes. Aromatic or aliphatic solvents of an inflammable nature are excluded for physiological reasons, and on the grounds of safety. Suitable resin binders are accordingly substances possessing high molecular weights and carrying groups which confer solubility in alkaline media. Examples of such groups are acid-anhydride groups, carboxyl groups, phenol groups, sulfonic acid groups, sulfonamide groups or sulfonimide groups. Resin binders with high acid-numbers are preferably employed, since these binders dissolve particularly easily in alkaline/aqueous-/alcoholic solvent-systems. Copolymers with anhydride groups can be used particularly successfully, since the absence of free acid groups results in the conductivity of the photoconductive coating being low when in the dark, accompanied by good solubility in alkaline media. Copolymers of ethylene or styrene with maleic acid anhydride are quite particularly suitable. Phenolic resins have also proved very successful. In addition, copolymers of styrene with methacrylic acid and methacrylates can also be employed as binders which are soluble in alkaline media. In particular, a copolymer composed of 1 to 35% of styrene, 10 to 40% of methacrylic acid, and 35 to 83% of n-hexylmethacrylate is used. A terpolymer, composed of 10% of styrene, 30% of methacrylic acid and 60% of n-hexylmethacrylate is outstandingly suitable.

The electrophotographic recording material according to the invention can contain levelling agents and plasticizers, as conventional additives in the photoconductive coating and/or adhesion-promoting agents between the coating-support and the photoconductive coating.

The proportion by weight of binder in the photoconductive coating, relative to the photoconductor, is variable and will generally be higher when monomeric photoconductors are present, preferably in the ratio of approximately 1:1, than when polymeric photoconductors are present, in which case there can, for example, be no binder at all.

The layer thickness of the photoconductive coating is not critical and generally lies within the range from about 2 to 10 μm, but can, if appropriate, exceed, or be less than these limits, depending on the particular application.

All the materials which are known to be used as coating-supports, in particular for the manufacture of printing forms by the electrophotographic route, can be employed, such as, for example, aluminum, zinc, magnesium, or copper, in the form of foils or plates, or multi-metal plates, as well as, moreover, cellulose products, such as, for example, special papers, cellulose hydrate films, cellulose acetate films, or cellulose butyrate films, the latter, in particular, in a partially saponified form. Plastic coating-supports can also be considered, such as, for example, polyamides, in the form of films, or metallized films. Aluminum foils which have been subjected to a surface-finishing treatment have proved particularly successful. The surface-finishing treatment comprises a mechanical or electrochemical roughening treatment and, if appropriate, a subsequent anodizing treatment, followed by a treatment with a silicate or with polyvinyl phosphonic acid in accordance with British Pat. No. 1,230,447. In addition, polyester films onto which aluminum has been applied by laminating or vapor-deposition, can also be considered for use in copying materials.

The exposure, whereby an image is projected onto the recording material, can be carried out with the aid of conventional light sources, but can also be carried out with the aid of lasers, including, in particular He/Cd lasers, Ar lasers, YAG lasers and He/Ne lasers.

The invention is explained in more detail by means of the non-limiting Examples which follow.

EXAMPLE 1

A solution of 45 parts by weight of 2,5-bis-(4'-diethylaminophenyl)-oxadiazole (OX), 45 parts by weight of a copolymer of styrene and maleic acid anhydride, possessing a softening point of 210° C., and 5 parts by weight of cellulose nitrate of the Standard Grade 4E according to DIN 53 179, was ground, together with 5 parts by weight of a dye according to Formula 4, in approximately 250 parts by weight of tetrahydrofuran (THF), in a ball-mill running at approximately 3,000 rpm, for 2 to 3 hours.

The homogeneous dye dispersion was subsequently spin-coated onto an aluminum foil, 100 μm thick, the surface of which had been wire-brushed, to form a coating which dried to a thickness of approximately 5 μm.

Further batches, composed of 45 parts by weight of OX, 45 parts by weight of a styrene/maleic acid anhydride copolymer, 2.5 parts by weight of dye (Formula 4), and 7.5 parts by weight of cellulose nitrate of Standard Grade 4E, and containing 45 parts by weight of OX, 40 parts by weight of copolymer, 10 parts by weight of dye (Formula 4), and 5 parts by weight of cellulose nitrate were prepared by a similar procedure.

The measurement of the photo-sensitivity was carried out as follows:

In order to determine the discharge curves under light, the test sample was moved, on a rotating plate, through a charging unit to the exposing station, where it was continuously exposed by means of a xenon lamp. A heat-absorbing glass and a neutral filter possessing a transparency of 15% were placed in front of the lamp. In the measuring plane, the light intensity lay within the range from 30 to 70 $\mu W/cm^2$, and was measured, by means of an optometer, immediately after determining the decay curve under light.

The charging level and the photo-induced decay curve under light were recorded by means of an electrometer, via a transparent probe, using an oscilloscope. The photoconductive coating was characterized by the charging level ($U_o$) and by that time ($T_{\frac{1}{2}}$), after which the charge had been reduced by half ($U_{o/2}$). The product of $T_{\frac{1}{2}}$ and the measured light intensity I ($\mu W/cm^2$) is the half-value energy $E_{\frac{1}{2}}$ ($\mu J/cm^2$).

The photosensitivity of the electrophotographic recording material was determined in accordance with this characterization method:

| Dye content of material (%) | Coating thickness (μm) | (+)$U_o$(V) | $E_{\frac{1}{2}}$ | (−)$U_o$(V) | $E_{\frac{1}{2}}$ |
|---|---|---|---|---|---|
| | 4–5 | 620 | 11.6 | 670 | 12.3 |
| 2.5 | 4–5 | 420 | 7.0 | 580 | 8.8 |
| 5 | 6–7 | 670 | 8.2 | 740 | 9.4 |
| 10 | 4–5 | 420 | 7.6 | 380 | 6.2 |
| Comparison material | approx. 3 | 480 | 21.3 | 490 | 20.4 |

Comparison of the photosensitivity with that of conventional electrophotographic printing plates according to German Pat. No. 2,526,720 showed a marked improvement in the discharge-behavior under illumination in the case of the recording materials according to the invention.

The higher photosensitivity of the materials according to the invention was also documented by means of the below-mentioned test. Using a corona unit, materials with the photoconductive coating A, according to the invention, containing 5% of dye and having a thickness of 6 to 7 μm, and a photoconductive coating B according to the above-mentioned German patent are negatively charged to approximately 450 V and contact-exposed in a copying-frame through a test original. Using a 15 W filament-type lamp at a distance of 65 cm, following developing by means of a commercially available dry toner, coating A yielded a background-free, well-exposed image after an exposure of less than 10 seconds, while, in the case of coating B, an exposure of approximately 30 seconds was necessary in order to obtain a similar image. The toner-image could be fixed by the action of heat, and could be treated with a commercially available, alkaline decoating solution (sodium metasilicate) in order to convert it into a printing form, this treatment being carried out for 30 to 60 seconds.

EXAMPLE 2

5 parts by weight of the dye according to Formula 4 were dispersed in a solution of 45 parts by weight of OX, 50 parts by weight of a copolymer of styrene and maleic acid anhydride, possessing a softening point of 210° C., in approximately 250 parts by weight of THF, and the resulting dispersion was intensively ground in a ball-mill for two hours.

The dispersion solution, in which the dye was finely dispersed, was then applied, as a coating to various coating supports, namely to a wire-brushed aluminum foil possessing a thickness of 100 μm (coating support 1), and to a 300 μm thick aluminum foil which had been electrochemically roughened, anodized and treated with polyvinylphosphonic acid (coating support 2). The dry thickness of the coatings was approximately 5 μm.

The measurement of the photosensitivities of these monodisperse coatings yielded the following values:

| Coating support | (±)$U_o$(V) | $E_{\frac{1}{2}}$ |
|---|---|---|
| 1 | (−) 655 | 7.9 |
| | (+) 655 | 8.0 |
| 2 | (−) 600 | 8.3 |
| | (+) 580 | 8.6 |

For comparison, and in order to measure the sensitivity to pre-exposure, the coating on coating support 1 and the comparison material according to Example 1 were subjected to repeated measurements, using negative charging, under conditions identical to those specified in Example 1:

| Material | Cycle | (−)$U_o$(V) | $E_{\frac{1}{2}}$ |
|---|---|---|---|
| Acc. to 1 | 1 | 550 | 8.4 |
| | 3 | 480 | 8.15 |
| | 5 | 450 | 8.4 |
| Comparison material | 1 | 510 | 18.7 |
| | 3 | 330 | 21.6 |
| | 5 | 290 | 23.6 |

The substantially more stable charging-behavior of the recording material according to the invention can be recognized. After keeping the coatings under room-illumination (110 μW/cm²) for 15 seconds, the comparison material could then be charged only to (−)40 V, while the recording material according to the invention could still be charged to (−)400 V.

The spectral photosensitivity of the recording material according to Example 2 (coating support 1) was determined in accordance with the method specified in Example 1, with filters placed in front of the lamp.

Using negative charging (420 to 430 V), the half-value time ($T_{\frac{1}{2}}$) in msec was determined for the wavelength region in question, by exposing the recording material. The spectral photosensitivity was obtained by plotting the reciprocal values of the product of the half-value time ($T_{\frac{1}{2}}$, in seconds) and the light intensity (I in μW/cm²) against the wavelength (in nm), the results being plotted as Curve 1 in FIG. 3. In this evaluation, the reciprocal value of $T_{\frac{1}{2}} \times I(1/E_{\frac{1}{2}})$ denotes the luminous energy, referred to unit area, which must be radiated into the coating in order to discharge it to half its initial voltage $U_o$.

The spectral photosensitivity of a material from Example 1, with a coating thickness of 4 to 5 μm, and containing 5 parts by weight of dye, for positive charging in the range from 340 to 280 V, was obtained in a similar manner, as represented by Curve 2 in FIG. 3.

EXAMPLE 3

THF solutions (250 parts by weight) containing 45 parts by weight of OX, 45 parts by weight of a styrene/-maleic acid anhydride copolymer (as in Example 1), and 5 parts by weight of cellulose nitrate of Standard Grade 4E were ground together with, in each case, 5 parts by weight of a dye according to Formula 1, or Formula 2, or Formula 3, to produce a fine dispersion, with grinding being carried out in a ball-mill for 2 hours.

The dye dispersion solutions were then applied, as coatings to an anodized aluminum plate, 300 μm thick, and the coating thickness was approximately 5 μm after drying.

The measurements on the samples containing the different dyes yielded the following values:

| Coating, with dye acc. to Formula No. | (+)$U_o$(V) | $E_{\frac{1}{2}}$ | (−)$U_o$(V) | $E_{\frac{1}{2}}$ |
|---|---|---|---|---|
| 1 | 655 | 15.8 | 660 | 17.9 |
| 2 | 805 | 24.4 | 820 | 21.9 |
| 3 | 820 | 17.6 | 760 | 22.9 |

EXAMPLE 4

A solution of 45 parts by weight of 2-phenyl-4-(2'-chlorophenyl)-5-(4''-diethylaminophenyl)-oxazole, 45 parts by weight of a copolymer of styrene and maleic acid anhydride (as in Example 1), 5 parts by weight of cellulose nitrate of Standard Grade 4E in 250 g of THF were finely ground with 5 parts by weight of a dye according to Formula 4, in a ball-mill for approximately 3 hours.

The dye dispersion was then coated onto wire-brushed aluminum foil and onto anodized aluminum foil, to produce coatings having a thickness, after drying, of approximately 5 μm.

The photosensitivities obtained, measured by a method similar to that of Example 1, can be seen from the following table:

| Coating support | (+)$U_o$(V) | $E_{\frac{1}{2}}$ | (−)$U_o$(V) | $E_{\frac{1}{2}}$ |
|---|---|---|---|---|
| Wire-brushed | 460 | 10.6 | 330 | 7.9 |
| Anodized | 430 | 12.2 | 390 | 7.7 |

EXAMPLE 5

5 parts by weight of a dye according to Formula 4 were added to a solution of 65 parts by weight of OX and 35 parts by weight of cellulose nitrate of Standard Grade 4E in 250 parts by weight of THF. The dye dispersion was afterwards ground to produce a very fine dispersion, grinding being carried out for 5 hours in a ball-mill. The homogeneous dispersion was then spin-coated onto a 75 μm thick polyester film onto which aluminum had been vapor-deposited, to produce coatings of various thicknesses, and dried in a circulating air drying box for 5 to 15 minutes at 90° to 105° C. The photosensitivities of these coatings were measured in a manner similar to that specified in Example 1, and the following values were obtained:

| Thickness of photoconductive coating (μm) | (+)$U_o$(V) | $E_{\frac{1}{2}}$ | (−)$U_o$(V) | $E_{\frac{1}{2}}$ |
|---|---|---|---|---|
| 5 | 640 | 11.6 | 550 | 11.1 |
| 10 | 770 | 8.0 | 780 | 10.1 |
| 20 | 790 | 7.1 | 840 | 12.0 |
| 25 | 640 | 7.0 | 710 | 15.8 |

EXAMPLE 6

5 parts by weight of a dye according to Formula 4 were added to a solution of 40 parts by weight of OX, 55 parts by weight of a commercially available, non-curable phenolic resin (melting point 83° to 88° C., acid number according to DIN 53 183 of less than 1) in 250 parts by weight of tetrahydrofuran, and the mixture was intensively ground in a ball-mill for 2 hours. The dispersion-solution, in which the dye was finely distributed, was then applied at various thicknesses to a 100 μm thick aluminum foil, the surface of which had been wire-brushed, and the photosensitivity was determined in accordance with the method specified in Example 1.

| Coating thickness (μm) | Charge (V) | $E_{\frac{1}{2}}$ ($uJ/m^2$) |
|---|---|---|
| 7 | −550 | 14.6 |
| | +550 | 13.6 |
| 10 | −670 | 15.5 |
| | +790 | 11.8 |

The coating was removed by means of a commercially available, aqueous/alcoholic decoating solution (sodium metasilicate), this operation being completed within 30 to 60 seconds and producing good printing plates.

EXAMPLE 7

25 parts by weight of a dye according to Formula 4 were ground to a fine dispersion in a solution of 75 parts by weight of a copolymer of styrene and maleic acid anhydride in tetrahydrofuran, grinding being carried out in a ball-mill for 3 to 4 hours.

The batch of dispersion was then applied as a coating to a 100 μm thick aluminum foil which had been wire-brushed, to produce a coating having a dry thickness of 4 to 5 μm, and the photosensitivity of this dispersion coating was determined.

Using a charge of −660 V, a half-value energy $E_{\frac{1}{2}}$ of approximately 84 μJ/cm² was determined, while the half-value energy was approximately 101 μJ/cm² when a charge of +430 V was used. Exposure was carried out by means of a xenon lamp, the exposure intensity being 193 μW/cm².

What is claimed is:

1. An electrophotographic recording material adapted for the manufacture of printing forms and printed circuits, comprising an electrically conducting support member; and a photoconductive insulating coating which is readily soluble in an alkaline medium and which comprises (i) a binder and (ii) a dye dispersed in said binder, which dye comprises a compound having the formula

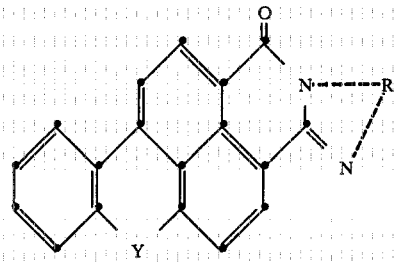

(II)

in which

Y is an oxygen atom, or a sulfur atom, and

R is a phenyl or naphthyl radical which is unsubstituted or substituted by nitro, or by alkyl, alkoxy or alkylcarboxy groups having 1 to 4 carbon atoms, or by halogen.

2. A recording material as claimed in claim 1, wherein the photoconductive insulating coating comprises a dye which is a compound having the formula II, in which R is phenyl or naphthyl which has been substituted by the nitro group.

3. A recording material as claimed in claim 1, wherein the dye comprises 10-methoxy-benzoxanthene-3,4-dicarboxylic acid anhydride.

4. A recording material as claimed in claim 1, wherein the dye is present in a concentration of from about 1 to 10 percent by weight, based on the solids content of the photoconductive coating.

5. A recording material as claimed in claim 1, wherein the dye is present, in the photoconductive coating, in particle sizes ranging from 0.01 to 1 μm.

6. A recording material as claimed in claim 1, wherein the proportion of dye, in the dispersion coating, does not exceed about 50 percent by weight, based on solid material.

7. A recording material as claimed in claim 1, wherein said binder is comprised of a copolymer having at least one anhydride group.

8. A recording material as claimed in claim 1, wherein said binder is comprised of a copolymer of ethylene or styrene and maleic acid anhydride.

9. A recording material as claimed in claim 1, wherein said binder is comprised of a copolymer of styrene and methacrylic acid and a methacrylate.

10. A recording material as claimed in claim 1, further comprising at least one material selected from the group consisting of an activator, a plasticizer, and a levelling agent.

* * * * *